US006117030A

United States Patent [19]

Green, Sr.

[11] Patent Number: 6,117,030

[45] Date of Patent: Sep. 12, 2000

[54] ILLUMINATED GAME BALL AND METHOD OF PLAY

[76] Inventor: Ronald J. Green, Sr., 508 S. Wilson St., Kennewick, Wash. 99336

[21] Appl. No.: 09/104,082

[22] Filed: Jun. 24, 1998

[51] Int. Cl.[7] ..... A63B 43/06

[52] U.S. Cl. ..... 473/570

[58] Field of Search ..... 473/570, 571, 473/593, 594, 610; 446/484, 485, 397

[56] References Cited

U.S. PATENT DOCUMENTS

| | | | |
|---|---|---|---|
| 3,011,048 | 11/1961 | O'Brien | 473/570 |
| 3,229,976 | 1/1966 | Allen, Jr. | 473/570 |
| 3,804,411 | 4/1974 | Hendry . | |
| 4,002,893 | 1/1977 | Newcomb et al. | 473/570 |
| 4,701,146 | 10/1987 | Swenson | 473/570 |
| 4,776,589 | 10/1988 | Yang . | |
| 5,066,011 | 11/1991 | Dykstra et al. . | |
| 5,228,686 | 7/1993 | Maleyko . | |
| 5,236,383 | 8/1993 | Connelly | 473/570 |
| 5,375,839 | 12/1994 | Pagani | 473/570 |
| 5,595,388 | 1/1997 | Swigart . | |
| 5,609,411 | 3/1997 | Wang | 473/570 |

*Primary Examiner*—Steven Wong
*Attorney, Agent, or Firm*—Seed IP Law Group, LLP; E. Russell Tarleton

[57] ABSTRACT

An illuminated game ball for use in playing a field game at night. The game ball includes an illumination case mounted within first and second shell halves and having batteries that are selectively connected to an LED for illuminating the game ball for nighttime play. A cap in the ball is rotated to one of three selective orientations to either illuminate the LED, extinguish the LED, or be removed to provide access to the battery compartments. Ideally the game ball is formed from translucent or transparent plastic that can be tinted with various colors.

16 Claims, 6 Drawing Sheets

ILLUMINATED GAME BALL AND METHOD OF PLAY

TECHNICAL FIELD

The present invention pertains to field games, and, more particularly, to a field game that uses an illuminated game ball and to a method of play that challenges players' skill in tossing game objects at the game ball.

BACKGROUND OF THE INVENTION

A wide variety of games are played both in the field and on the court where a ball is kicked, thrown, bounced, paddled, and batted as part of game play. Such game balls must have a heavy-duty construction in order to withstand the extreme forces exerted on them.

Several designs have been proposed for illuminating game balls to enable play in dark conditions. One design, found in U.S. Pat. No. 5,066,011, utilizes a flash tube mounted inside a bounceable ball that flashes when the ball is bounced off a hard surface. Expensive, heavy-duty, electrical components must be used to survive the shock forces resulting from the ball repeatedly rebounding off the hard surface.

A lighted inflatable ball is disclosed in U.S. Pat. No. 4,776,589, which describes the mounting of a soft PVC membrane inside an inflatable shell. The membrane holds a battery cell, a switch, and wiring that passes from the battery cell through the soft membrane layer to an airtight fuse and then to a light bulb. Here, airtight construction must be used for inflatability.

U.S. Pat. No. 5,228,686, is directed to a lighted rubber ball having LED elements and rechargeable batteries mounted on the interior. The ball is formed from solid, high impact resistant rubber so as to bounce with a high velocity.

These and other designs utilize components and materials that, while generally suitable for their purposes, make the devices expensive to design and manufacture and render them undesirable for applications where such custom design and high manufacturing cost is not needed. Hence, there is a need for an illuminated game ball designed for relatively simple manufacture, assembly, and use in conjunction with a unique and novel method of game play that uses the ball passively, i.e., as a target to which other game objects are thrown in an attempt to land in as close proximity to the ball as possible.

SUMMARY OF THE INVENTION

The present invention is directed to an illuminated game ball having a spherical body formed of at least two sections joined together to define an interior chamber. Ideally, the spherical body is formed substantially of light-conducting material that is at least translucent and includes an opening that communicates with the interior chamber. A case sized and shaped to be received within the interior chamber is provided. The case includes at least one battery compartment, a mount for a light source, and a switch for selectively activating the light source.

In accordance with another aspect of the present invention, the case includes one or more weight compartments for holding at least one weight. An access opening in the case provides access to the battery compartment, with the access opening defined by a cylindrical collar sized and shaped to be received within the opening in the spherical body.

In accordance with yet another aspect of the present invention, the switch is formed in a cap that is used for closing the access opening in the case. The cap also includes a contact for connecting an electrical energy source in the battery compartment to a light emitting device mounted in the case. As such, the case is preferably formed from material that is at least translucent, and, more preferably, the case and the spherical body are formed from transparent material.

In accordance with a further aspect of the present invention, a ramp is formed in one of either the collar and the cap, and a ramp engaging member is formed in the other of the collar and the cap, with the ramp and the ramp engaging member cooperating to hold the cap in selective orientations on the collar. In one embodiment, three selective orientations are provided, one for activating the light source, one for deactivating the light source, and one for disengaging the cap from the case to enable changing of battery cells in the battery compartment.

A method for playing a game using the illuminated game ball is also disclosed. The method comprises (a) positioning a target sphere on a playing surface; and (b) projecting one or more objects toward the target sphere in order to position the one or more objects in as close proximity to the target sphere as possible. When played at night, the target sphere is initially illuminated prior to positioning on the playing surface to enable players to see the target sphere more easily. Ideally, the one or more objects tossed toward the target sphere comprise balls that can be thrown, tossed, or rolled toward the target sphere. Other objects such as tennis balls and the like may be used so long as they are nondestructive to the target sphere should contact be made.

In accordance with another embodiment of the method of playing a game with a target sphere and one or more game objects, the method comprises (a) positioning the target sphere on a playing surface, and (b) each player taking a turn by projecting one or more game objects toward the target sphere in an attempt to have the final resting place of the one or more game objects closest in proximity to the target sphere than the game objects of the other players. In accordance with another aspect of the method of the present invention, the step of positioning the target sphere on the playing surface includes determining a player who will position the target sphere on the playing surface. Ideally, determining the player who will position the target sphere also determines the first player to take a turn, which can be the player who is selected to position the target sphere on the playing surface.

In accordance with yet another aspect of the present invention, the step of positioning the target sphere on the playing surface can include tossing, throwing, or rolling the target sphere on the playing surface. When played at night, the step of positioning the target sphere further includes activating a light source internal to the target sphere to illuminate the target sphere.

In accordance with still yet a further aspect of the present invention, the method includes the additional step of awarding points to each player in accordance with the proximity of each player's one or more game objects to the target sphere. In one embodiment, higher points are awarded for game objects that are touching or closest in proximity to the sphere than are objects having a more distant final resting place. In accordance with another aspect of the method of the present invention, each player may have one or more game objects to project toward the target sphere.

Thus, the present invention provides an illuminated game ball having a self-contained illumination source that lights the entire ball for nighttime play. The ball is designed with as few components as possible and with easy assembly steps to facilitate economic manufacture, assembly, and use. The method of game play has few steps, is simple to score, and is playable yet challenging for players from very young ages to the elderly. Play can be accomplished in daylight and nighttime hours without the need for bright external lighting.

BRIEF DESCRIPTION OF THE DRAWINGS

The advantages and features of the present invention will be more readily appreciated as the same become better understood from the accompanying detailed description when taken in conjunction with the following drawings, wherein.

DETAILED DESCRIPTION OF THE INVENTION

Figure 1:
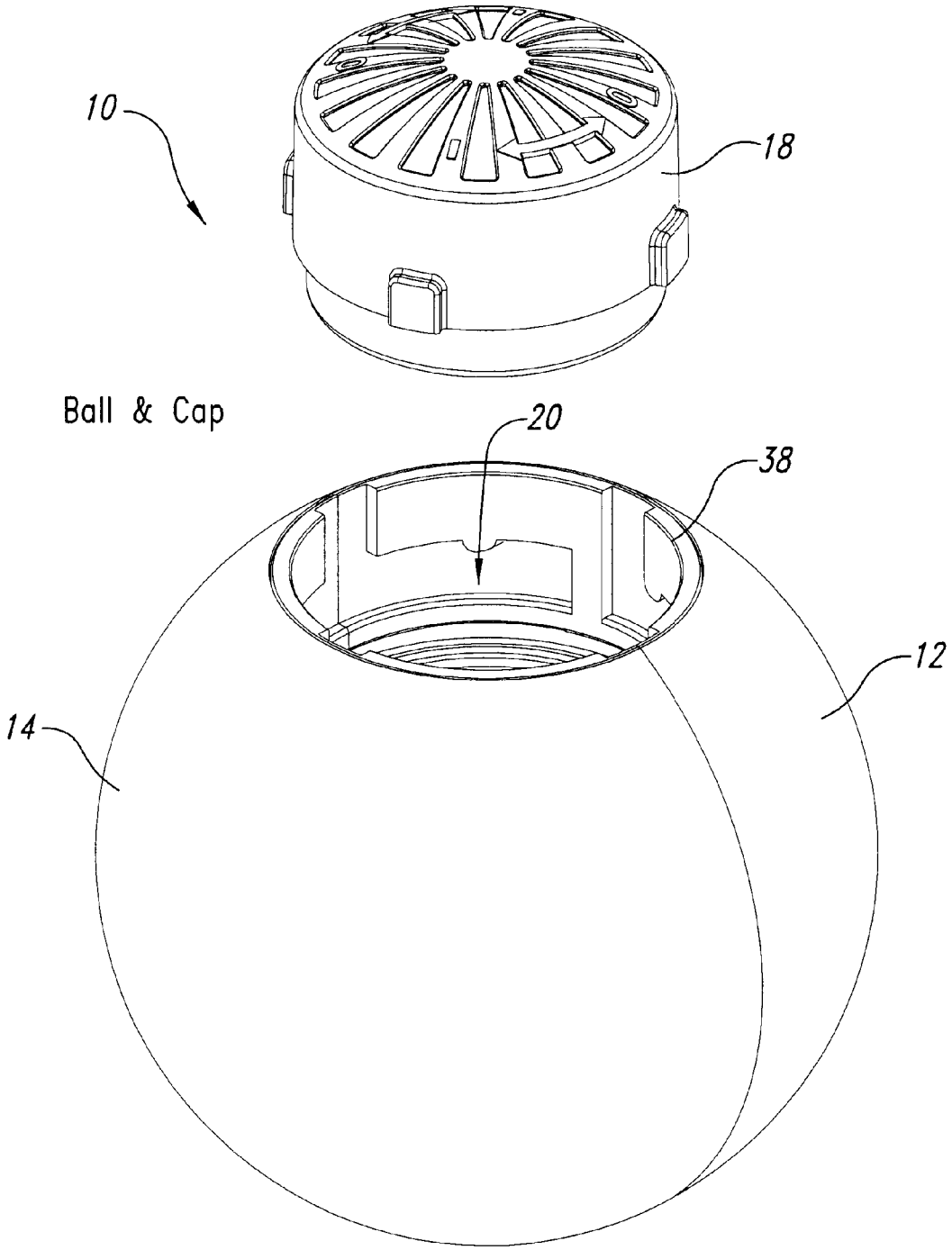
FIG. 1 is an exploded view of an illuminated game ball and battery compartment cap formed in accordance with the present invention.
Figure 2:
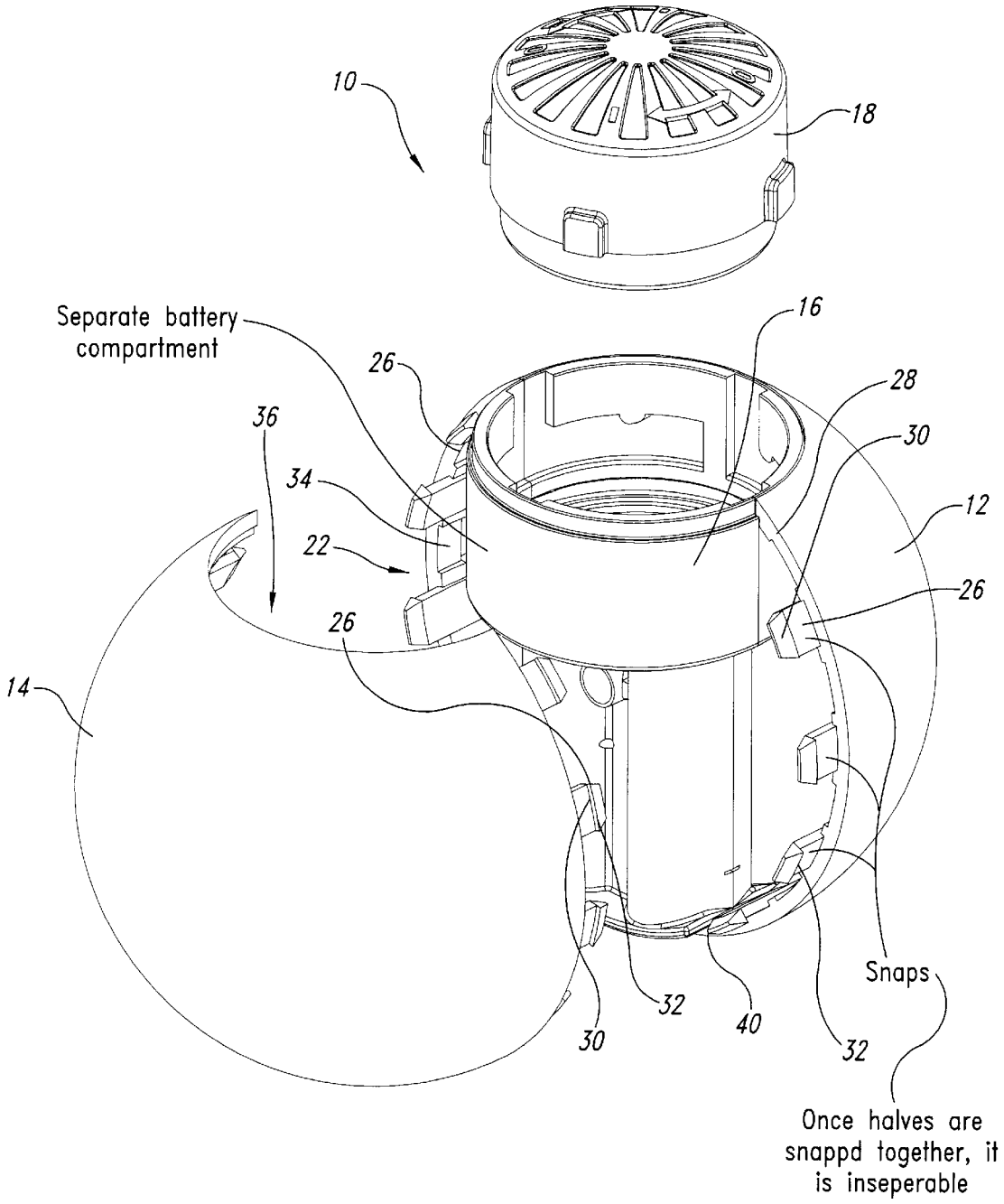
FIG. 2 is a further exploded view of the two halves of the illuminated game ball of FIG. 1 exposing the self-contained illumination case.
Figure 3:
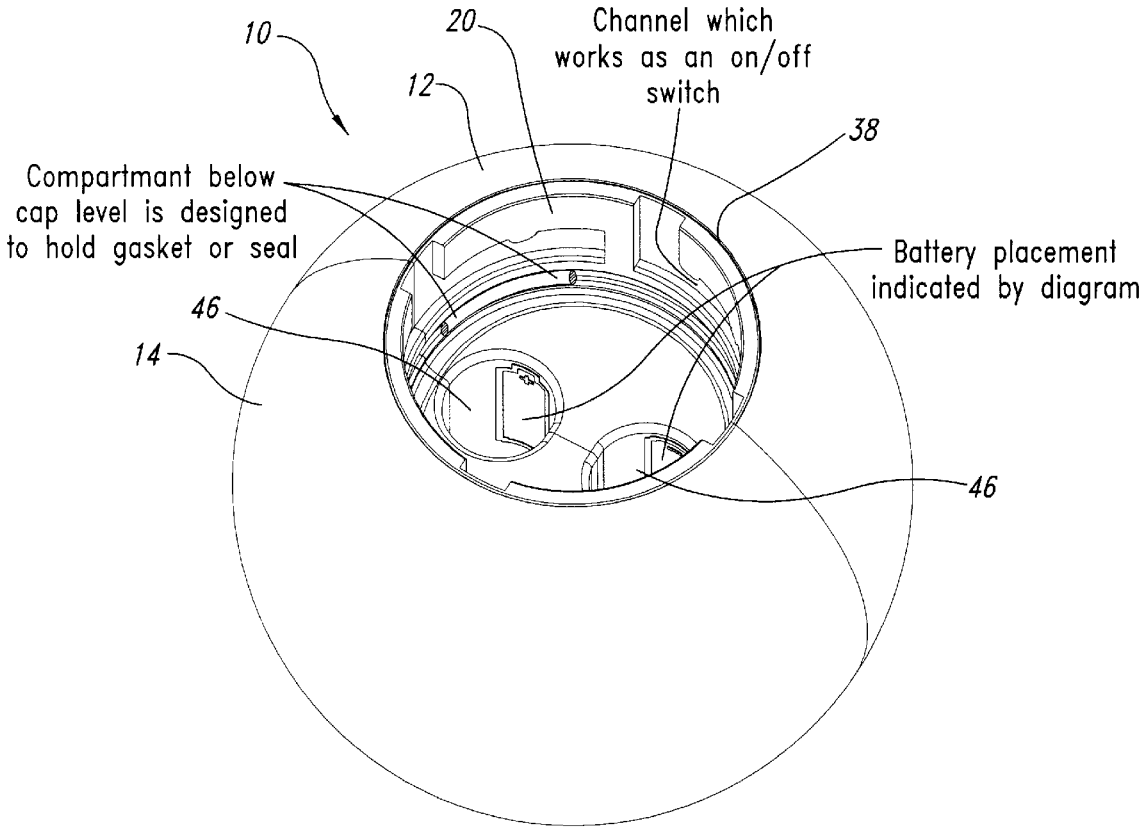
FIG. 3 is an enlarged view of the interior of the illumination case formed in accordance with the present invention as viewed through an access opening.

Referring initially to FIGS. 1–3, illustrated therein is an illuminated game ball 10 formed in accordance with the present invention. In this embodiment, the game ball 10 is formed of a first half 12 and a second half 14 that enclose an illumination case 16. A cap 18 is received within an access opening 20 in the illumination case 16.

The first and second halves 12, 14 are formed from a hemispherically-shaped shell 15 that has a hollow interior 22. As shown more clearly in FIG. 2, each shell 15 has a plurality of snaps 24 projecting from an interior surface 26 and extending beyond a circumscribing edge 28. Each snap 24 has a tapered head 30 with a lip 32 formed thereon for engaging with a corresponding ledge 34 formed on the interior surface 26 of the other hemispherical half. Thus, when the two halves 12, 14 are placed together with their mating edges 28 in abutting relationship, the plurality of snaps 24 will engage the ledges 34 to hold the two halves 12, 14 permanently together.

Each half shell 12, 14 has a semicircular opening 36 cut out of a section of the mating edge 28. The semicircular opening 36 is sized and shaped such that when the half shells 12, 14 are placed together, the combined semicircular openings 36 form a single circular opening 38 that communicates with the hollow interior 22 of the ball 10 and provides access to the illumination case 16 mounted inside the ball 10. A pair of grooves 40 are formed on the interior surface 26 of each half shell 12, 14 to receive the illumination case 16. Preferably, the grooves 40 are formed on a side or pole of the ball 10 that is opposite the circular opening 38.

Figure 6:
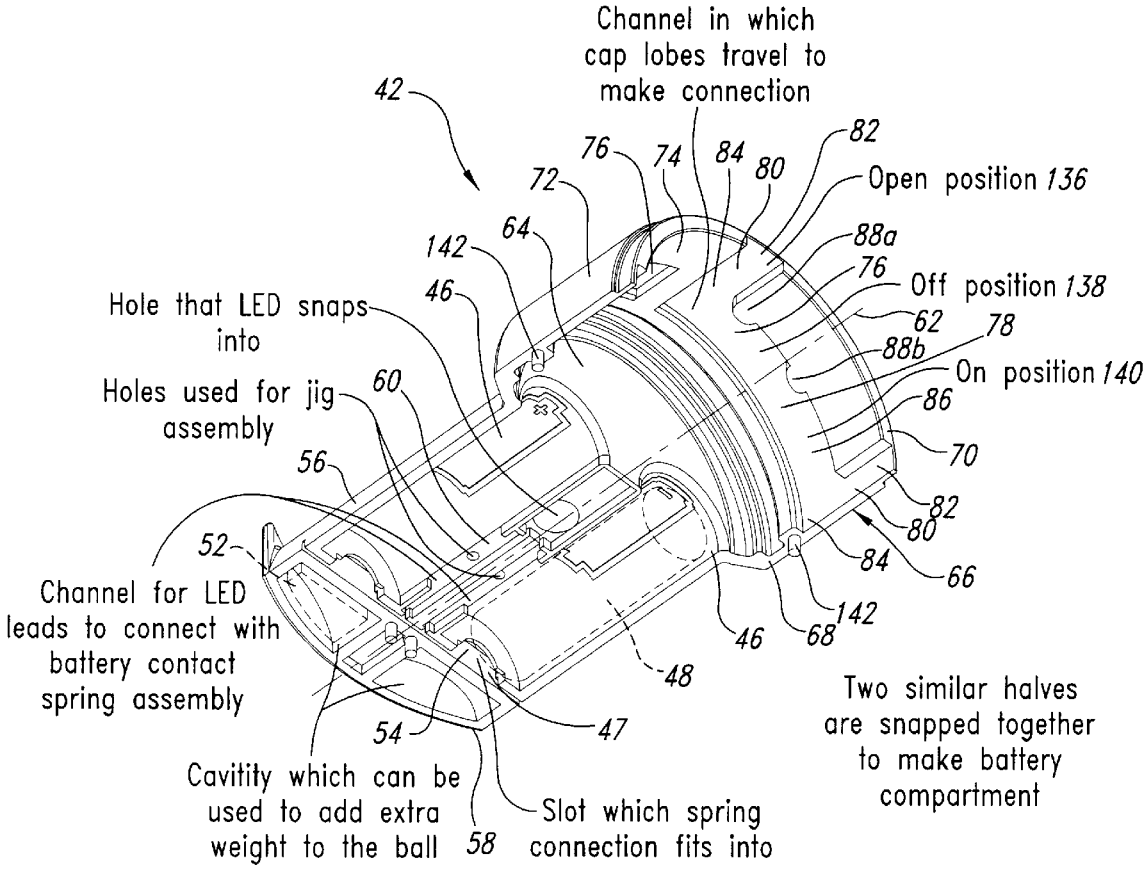
FIG. 6 is an isometric projection of an interior of one half of the illumination case.
Figure 7:
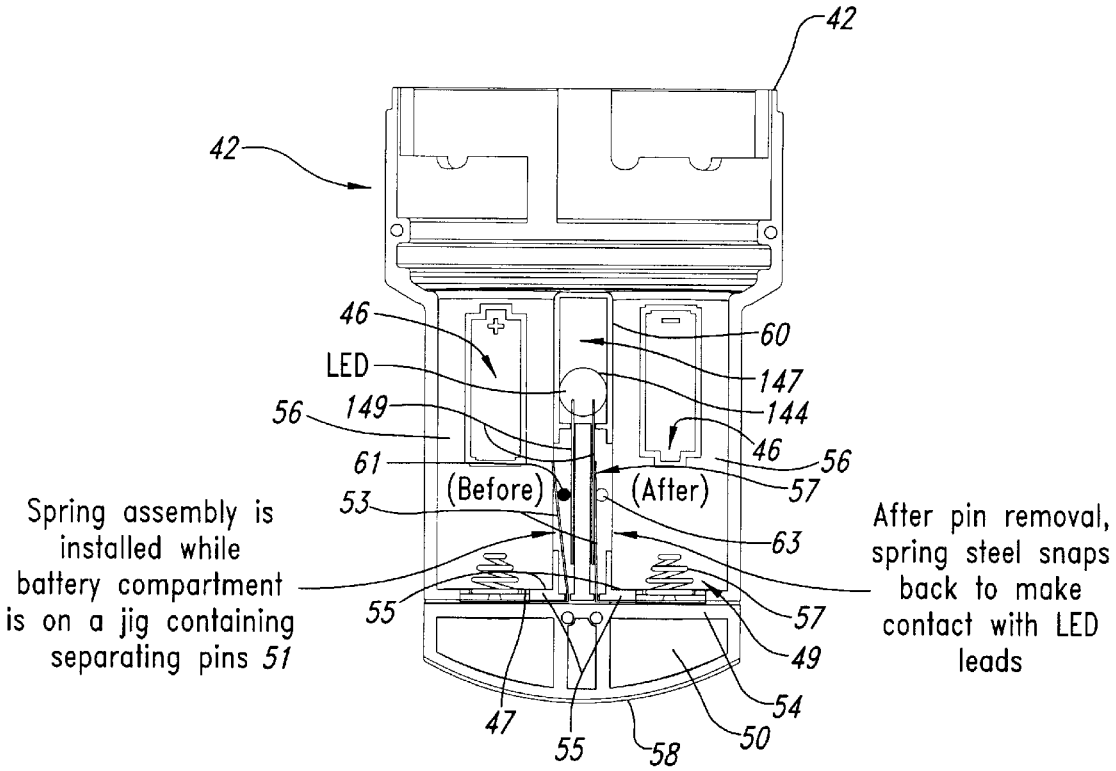
FIG. 7 is a side plan view of the illumination case formed in accordance with the present invention showing installation of selected components.

The illumination case 16 comprises two nearly identical halves 42, 44, with one of the halves 42 illustrated in FIGS. 6 and 7. Each half includes the respective halves of two battery compartments 46 for holding two cylindrical batteries 48. Positioned below each battery compartment 46 is a weight compartment 50 for holding optional weights 52. The battery compartments 46 have a floor 54 that separates the weight compartments 50 from the battery compartments 46. The optional weights 52 are added prior to assembly as desired to give the game ball 10 additional weight. The batteries 48 and weights 52 are positioned to provide better weight distribution and enable the game ball 10 to roll substantially evenly. An arcuate sidewall 56 and an arcuate bottom wall 58 enclose the battery compartments 46 and weight compartments 50.

Each battery compartment 46 has a slot 47 formed in the floor 54 for receiving a spring contact 49. The spring contact 49 consists of an L-shaped contact spring 51 having a stem portion 53 and a base portion 55. It is the base portion 55 that is slid into the slot 47. The base portion 55 and the stem portion 53 are formed at a substantially right angle to one another such that when installed, the stem portion 53 is parallel to the vertical wall 60. As shown more clearly in FIG. 7, an LED 144 is installed in a mounting space 147 formed in the vertical wall 60. The LED leads 149 extend downward adjacent to the battery compartments 46 where they contact the stem portion 53 of each spring contact assembly 49.

The base portion 55 includes a coil spring contact 57 that is connected to the base portion S and extends upward into the battery compartment 46 to bear against a battery 48 and make electrical contact. When the spring contact assemblies 51 are initially installed, the illumination case half 42 is placed over a jig that has a pin 61 projecting through openings 63 formed in the illumination case half 42 and 44. The spring contact assembly 51 is placed into the illumination case half 42 with the stem portion 53 bearing against the pin 61. This enables the LED 144 to be installed in the mounting space 147 with its leads 149 projecting down adjacent to the stem portion 53 of the spring contact assembly 51. When the illumination case half 42 is removed from the jig, the pins 61 slide out of the opening 63 and permit the stem portion 53 to spring into contact with the LED lead 49 (this is illustrated in the "before" view shown on the left side of FIG. 7 and the "after" view shown on the right side of FIG. 7).

The longitudinal wall 60 extends along the longitudinal axis 62 of the case half 42 from the arcuate bottom wall 58, through the floor 54, and to a transverse wall 64 below the access opening 20. The access opening 20 is formed by a collar 66 that has one end 68 integrally formed with the case half 42. The second end 70 is sized and shaped to be received within the circular opening 38 formed by the first and second half shells 12, 14. The collar 66 has an exterior surface 72 that is substantially smooth in this embodiment and an interior surface 74 that has two ramps 76 formed therein. Each ramp 76 comprises a channel formed on the interior surface 74 of the collar 66. The channel 78 has two longitudinal channel portions 80 that have one end 82 opening to the second end 70 of the collar and a second end 84 that connects to a transverse channel 86 adjacent the interior surface 64 of the access opening 20. Two lobes 88 project down into the transverse channel 86 to act as detents for the cap 18.

Figure 4:
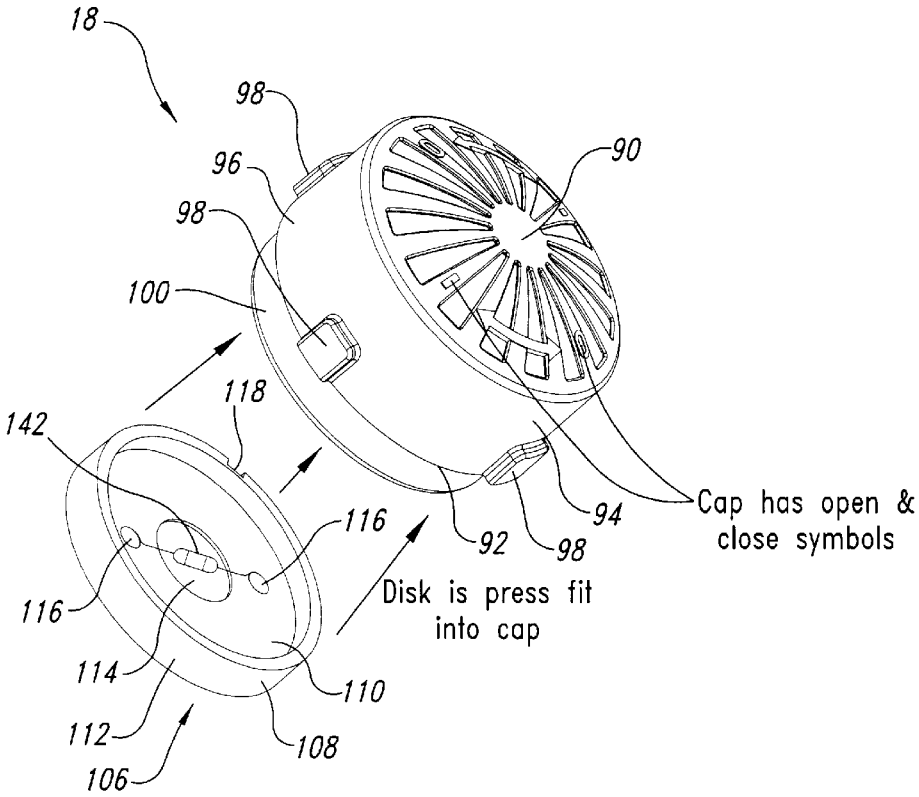
FIG. 4 is an exploded view of the cap and disk formed in accordance with the present invention.
Figure 5:
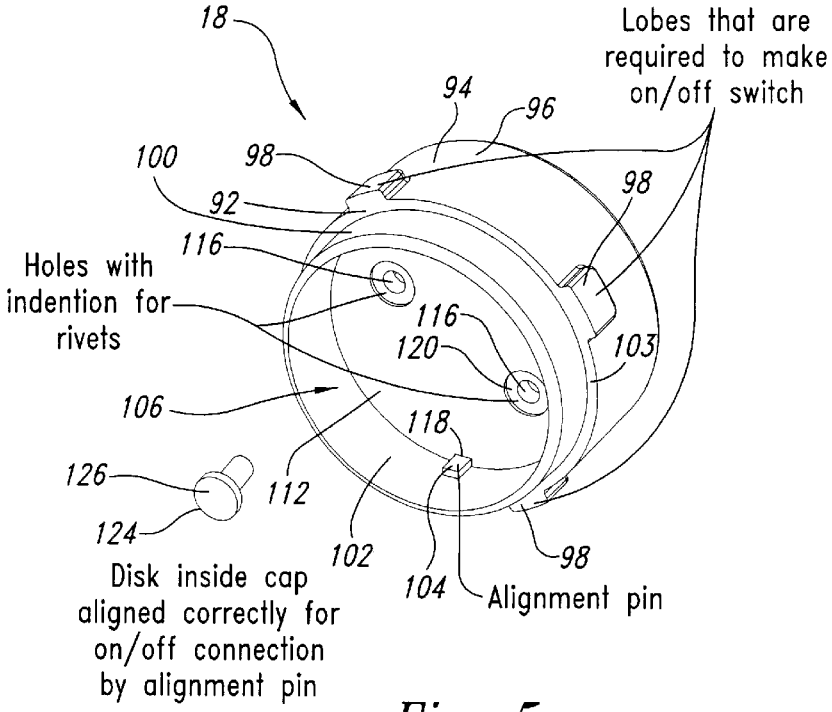
FIG. 5 is an interior view of the cap with the disk inserted therein.

Turning next to FIGS. 4 and 5, shown therein is a cylindrical cap 18 having a closed top 90 and an open bottom 92 circumscribed by a continuous sidewall 94. The exterior 96 of the sidewall 94 has four projections 98 extending outward therefrom. The projections 98 have a substantially square shape and are spaced equidistantly around the circumference of the sidewall 94 of the cap 18.

A skirt 100 extends downward from the interior surface 102 of the cap 18, and it has a diameter smaller than the diameter of the sidewall 94, which creates a circumferential lip 103. An alignment key 104 is formed on the interior surface 102 that is used to align a disk 106 (shown before installation in FIG. 4) inside the cap 18, as described more fully below.

The disk 106 has an annular sidewall 108 integrally formed with a bottom wall 110. As shown in FIG. 4, the interior surface 112 of the disk 106 has a circular recessed portion 114 centrally disposed therein. A pair of holes 116 are formed through the bottom wall 110. A slot 118 is formed in the annular sidewall 108, as shown more clearly in FIG. 5, and a countersink area 120 is formed around each hole 116 in the exterior surface 122 of the bottom wall 110 in which a rivet 124 is placed. The disk 106 is sized and shaped to be slid within the skirt 104 on the interior of the cap 18. The slot 118 in the disk 106 slides over the alignment key 104 to hold the disk 106 in a predetermined orientation with respect to the cap 18.

The lobes 98 on the cap 18 are sized and shaped to be slidably received within the ramps 76 formed on the interior surface 74 of the collar 66. The lobes 98 on the cap 18 cooperate with the lobes 88 in the channels 78 to hold the cap in selected orientations with respect to the illumination case 16. Rivets 124 are pressed into the holes 116 with the heads 126 resting in the countersink area 120. Thus, the rivets 124 will be slightly recessed within the disk 106.

In assembly, each of the illumination case halves 42, 44 are filled with the appropriate weights 52 as desired, and the spring retainer battery contacts 128 are installed in the battery contact slots 130 formed in the battery compartment floor 54, as shown in FIG. 6. The two halves 42, 44 are placed in mating relationship and adhesively attached together using a suitable adhesive for the material. To aid in alignment, alignment posts 132 in illumination case half 42 can be formed thereon to insert within mating openings (not shown) in illumination case half 44.

After the illumination case 16 is assembled, it is slidably inserted into the grooves 40 formed in the hollow interiors 22 of each of the first and second half shells 12, 14. The illumination case collar 66 is slid into the semicircular opening 36 formed in one of the shells 12. The other half shell 14 is then placed over the illumination case 16 into abutting relationship with the first half shell 12 so that the snaps 24 engage each of the half shells 12, 14, to hold them in unreleasable engagement.

A battery 48 is inserted into each battery compartment 46 in the orientation shown in the legend formed on the arcuate sidewalls 56 of the battery compartments 46 (see FIG. 6). After the batteries are properly installed, the cap 18 with the disk 106 press-fit into it is positioned in the circular opening 38 in the ball 10. The lobes 98 on the cap 18 engage the ramps 76 in the collar 66 on the illumination case 16. The cap 18 is then pushed downward into the access opening 28 and turned to one of three selective orientations shown in FIG. 6. In the first orientation, the cap lobes 98 are pushed into the longitudinal slots 80. In the second orientation 138, the cap 18 is turned clockwise so that the cap lobes 98 rest between the two ramp lobes 88. In the third orientation 140, the cap 18 is turned clockwise further until the cap lobes 98 are past the second ramp lobes **88*b*, which is the "on" position. In the "on" position, the rivet heads 126 in the cap 18 move into contact with the ends of the batteries 48. A resistor 142 is in contact with the rivets 124 so that the resistor 142 rests in the recessed portion 114 of the disk. Thus, the rivets make contact with the batteries when the cap 18 is in the third orientation, completing an electric circuit that lights up the LED 144**.

The illuminated game ball 10 components can be made of at least translucent material, and, more ideally, from transparent material that readily conducts light. The material may be tinted with one or more colors, as desired. The game ball components 10 are preferably constructed of high impact resistant plastic formed from a cellulosic material. Other materials having the same qualities and properties of durable, break-resistant plastic may be used without departing form the spirit and scope of the invention.

For instance, the disk 18 and the illumination case 16 are molded from clear plastic. Assembly consists of pushing two eyelets or rivets 124 through the holes 116 in the disk 106, setting the resistor 142 in place in the recessed portion 114, and wrapping the resistor leads around the eyelets or rivets 124. A press can be used to stake the eyelets over.

The illuminated game ball 10 is designed to be used in conjunction with a novel method of playing a field game, which will now be described in conjunction with the illuminated game ball 10. In accordance with one method of play, the game ball 10 is positioned on a playing surface, such as a grass field as a target. However, the playing surface may also consist of sand, gravel, dirt, and the like. Players then toss or throw objects such as other game balls 10, toward the target game ball 10 in an attempt to position the game object as close as possible to the target game ball 10. In one method of scoring, players score more points when their game object lands closer to the game ball 10 than the game objects of other players, with the highest points being awarded to the player whose game objects are in contact with the game ball 10 when they come to rest.

To play one version of the game, a player is initially selected to position the game ball on the playing surface. A coin toss may be used to decide the player who will position the game ball. Preferably, the selected player takes the game ball and tosses or rolls it onto the playing surface wherever the player desires. This player then becomes the first player to take a turn at tossing game objects at the game ball 10. These game objects may take the form of other, smaller balls, such as tennis balls. Game objects may also take the form of soft lawn darts, or other objects that are of a composition that is nondestructive to the game ball 10.

In one embodiment of the invention, each player's game objects have a unique color and can be illuminated. Players take turns throwing their game objects in the order in which their game colors occur. For instance, the order of play can be orange, yellow, green, red. If the player chosen to position the game ball 10 has the green game objects, then the next player to take a turn will be the player with the red game objects. During a turn, each player may throw one or more game objects at the game ball. It is permissible to knock another player's game objects from their final resting place during a turn.

At night, the game ball 10 is illuminated by turning the cap 18 to the third orientation, as described above. This provides a readily visible target for the players to throw at. In a preferred embodiment, the target game ball 10 will flash on and off or flash alternating colors, such as red and green, when illuminated. Commercially available flashing LED lights may be mounted in each half 42, 44, or suitable circuitry may be used as known to those skilled in the art. If used as a player's game object to be thrown at a target ball, the game ball 10 would be configured to remain steadily illuminated. In daylight the target game ball 10 is a translucent white while the object game balls 10 are colored to distinguish them from the target game ball.

After each player has taken a turn, scoring takes place as described above. The total points for the resting place of each player's game objects are summed, and the player with the highest total score wins the round. Multiple rounds may be played to complete a game or the game may consist of only one round of turns.

From the foregoing it will be appreciated that, although specific embodiments of the invention have been described herein for purposes of illustration, various modifications may be made without deviating from the spirit and scope of the invention. For example, the halves 42, 44 may be glued together instead of or in addition to the use of snaps. Accordingly, the invention is not limited except as set forth in the appended claims.

The embodiments of the invention in which an exclusive property or privilege is claimed are defined as follows:

1. An illuminated game sphere, comprising:

a spherical body formed of at least two sections joined together to form an interior chamber, said spherical body having an opening that communicates with said interior chamber, said spherical body formed substantially of light conducting material that is at least translucent; and a case sized and shaped to be received within said interior chamber, said case having at least one battery compartment, a mount for a light source, a weight compartment for holding one or more weights, and a switch coupled between the mount and the battery compartment, said case further comprising an opening for providing access to said battery compartment, said access opening defined by a cylindrical collar sized and shaped to be received within said opening in said spherical body, and further wherein said switch comprises a cap sized for closing said access opening in said case, said cap having a contact for connecting an electrical energy source to a light source.

2. The sphere of claim 1 wherein said case is formed from a transparent material.

3. The sphere of claim 1, further comprising at least one ramp formed in one of either said collar and said cap and at least one ramp engaging member formed in the other of said collar and said cap, said ramp and said ramp engaging member cooperating to hold said cap in selected orientations on said collar for selectively activating a light source.

4. An illuminated game ball, comprising:

a spherical body formed of light conducting material that is at least translucent, said spherical body having a hollow interior and an opening that communicates with said hollow interior; and a self-contained light source mounted in said hollow interior of said spherical body, said self-contained light source comprising a case having a battery compartment, at least one battery mounted in said battery compartment, an illumination mount, at least one light source held by said illumination mount, a weight compartment for holding one or more weights, and a switch coupled between the switch and the battery for selectively activating said light source, said switch further including a closure member for closing said opening in said spherical body, said case further includes an access opening for providing access to said battery compartment, said access opening defined by a cylindrical collar sized and shaped to be received within said opening in said spherical body, and further wherein said switch is sized and shaped to be threadably engaged with said cylindrical collar.

5. The ball of claim 1, further comprising at least one ramp formed in one of either said collar and said cap, and at least one ramp engaging member formed in the other of said collar and said cap, said ramp and said ramp engaging member cooperating to hold said cap in selective orientations on said collar for selectively activating and deactivating said light source.

6. The ball of claim 5 wherein said case is formed from material that is at least translucent.

7. The ball of claim 5 wherein said case is formed from material that is at least transparent, and further wherein said spherical body is formed from light conducting material that is at least transparent.

8. An illuminated ball for playing a game in daylight and at night, the ball comprising:

a spherical body formed from a first hemispherical shell and a second hemispherical shell, said first and second hemispherical shells each having a hollow interior, each of said first and second hemispherical shells further having engaging means formed on an edge such that when said first and second hemispherical shells are joined together with their edges in abutting relationship, said engaging means holds said hemispherical shells together in unreleasable engagement, and said first and second hemispherical shells each having a semicircular portion cut out from said shells such that when said hemispherical halves are unreleasably engaged together, said semicircular portions form a circular opening that communicates with said hollow interiors; and a self-contained source of illumination comprising a case formed of two halves, each half having an enclosed weight compartment, means for mounting an illumination means, an access opening to said battery compartment, and a closure means for closing said access opening to said battery department, said case being sized and shaped to be slidably engaged within said hollow interiors of said first and said second hemispherical shells such that when said hemispherical shells are unreleasably joined together, said case is permanently held in said spherical body, said case further including a collar integrally formed thereon having one end that communicates with said access opening to said battery compartment and a second end that is sized and shaped to be received within said circular opening formed in said spherical body, and said closure means being sized and shaped to be received within said collar in releasable engagement to form an arcuate portion of said spherical body to enable said spherical body to roll on a surface, said closure means further including contact means for electrically connecting an electric cell to an illumination means for selectively illuminating said spherical body, said spherical body and said case being further formed of light conducting material that is at least translucent.

9. The ball of claim 8, further including at least one electric cell mounted in said battery compartment and at least one illumination means mounted in said illumination mounting means.

10. The ball of claim 9, further comprising ramp means formed in one of either said collar and said closure means and ramp engaging means formed in the other of said collar and said closure means, said ramp means and said ramp engaging means cooperating to hold said closure means in selective orientations to enable selective activation and deactivation of said illumination means.

11. An illuminated game sphere, comprising:

a spherical body formed of at least two sections joined together to form an interior chamber, the spherical body having an opening that communicates with the interior chamber, the spherical body formed of substantially light-conducting material that is at least translucent; and a case sized and shaped to be received within the interior chamber, the case comprising at least one battery compartment, a mount for a light source, a switch coupled between the mount and the battery compartment, an opening for providing access to the battery compartment, the access opening defined by a cylindrical collar sized and shaped to be received within the opening in the spherical body, and further wherein the switch comprises a cap sized for closing the access opening in the case, the cap including a contact for connecting an electrical energy source to a light source.

12. An illuminated game sphere, comprising:

a spherical body formed of at least two sections joined together to form an interior chamber, the spherical body having an opening that communicates with the interior chamber and formed substantially of light conducting material that is at least translucent; and a case sized and shaped to be received within the interior chamber, the case having at least one battery compartment, a mount for a light source, an opening for providing access to the battery compartment, the access opening defined by a cylindrical collar sized and shaped to be received within the opening in the spherical body, and a switched coupled between the mount and the battery compartment, the switch comprising a cap sized for closing the access opening in the case, and further comprising at least one ramp formed in one of either the collar and the cap and at least one ramp engaging member formed in the other of the collar and the cap, the ramp and the ramp engaging member cooperating to hold the cap in selected orientations on the collar for selectively activating a light source.

13. An illuminated game ball, comprising:

a spherical body formed of light conducting material that is at least translucent, the spherical body having a hollow interior and an opening that communicates with the hollow interior; and a self-contained light source mounted in said hollow interior of the spherical body, the self-contained light source comprising a case having a battery compartment, at least one battery mounted in the battery compartment, an illumination mount, at least one light source held by the illumination mount, a switch coupled between the switch and the battery for selectively activating the light source, the switch further including a closure member for closing the opening in the spherical body, and an access opening formed in the case for providing access to the battery compartment, the access opening defined by a cylindrical collar sized and shaped to be received within the opening in the spherical body, and the switch being sized and shaped to be threadably engaged with the cylindrical collar.

14. The illuminated game ball of claim 13, further comprising at least one ramp formed in one of either the collar and the cap, and at least one ramp engaging member formed in the other of the collar and the cap, the ramp and ramp engaging member cooperating to hold the cap in selective orientations on the collar for selectively activating and deactivating the light source.

15. The illuminated ball of claim 14 wherein the case is formed from material that is at least translucent.

16. The illuminated game ball of claim 14 wherein the case is formed from material that is at least transparent, and further wherein the spherical body is formed from light-conducting material that is at least transparent.

* * * * *